US010605276B2

(12) United States Patent
Iverson et al.

(10) Patent No.: US 10,605,276 B2
(45) Date of Patent: Mar. 31, 2020

(54) POSITION DEPENDENT VALVE DEVICE FOR CONTROL CYLINDER

(71) Applicant: KONGSBERG AUTOMOTIVE AS, Kongsberg (NO)

(72) Inventors: Bjørn Iverson, Kongsberg (NO); Steffen Johnsen, Drammen (NO); Kent Häll, Drammen (NO)

(73) Assignee: KONGSBERG AUTOMOTIVE AS, Kongsberg (NO)

( * ) Notice: Subject to any disclaimer, the term of this patent is extended or adjusted under 35 U.S.C. 154(b) by 0 days.

(21) Appl. No.: 15/573,307

(22) PCT Filed: May 12, 2016

(86) PCT No.: PCT/IB2016/052754
§ 371 (c)(1),
(2) Date: Nov. 10, 2017

(87) PCT Pub. No.: WO2016/181350
PCT Pub. Date: Nov. 17, 2016

(65) Prior Publication Data

US 2018/0094653 A1 Apr. 5, 2018

Related U.S. Application Data

(60) Provisional application No. 62/160,364, filed on May 12, 2015.

(51) Int. Cl.
*F15B 15/20* (2006.01)
*F15B 15/14* (2006.01)

(52) U.S. Cl.
CPC ..... *F15B 15/204* (2013.01); *F15B 15/149* (2013.01); *F15B 15/1428* (2013.01); *F15B 15/1452* (2013.01)

(58) Field of Classification Search
CPC ... F16F 9/585; F16F 9/58; F16F 9/348; F15B 15/1428; F15B 15/204; F15B 15/1452; F15B 15/149
See application file for complete search history.

(56) References Cited

U.S. PATENT DOCUMENTS 3,818,805 A 6/1974 Johansson
4,191,150 A 3/1980 Siewert
(Continued)

FOREIGN PATENT DOCUMENTS

DE 102004037282 A1 2/2006
DE 102005035633 A1 3/2006
(Continued)

OTHER PUBLICATIONS

Machine Assisted English language abstract for DE 102005035633, downloaded from Espacenet.com on Nov. 10, 2017; 75 pages.
(Continued)

*Primary Examiner* — Abiy Teka
(74) *Attorney, Agent, or Firm* — Howard & Howard Attorneys PLLC

(57) ABSTRACT

A position dependent valve device (10) for a control cylinder (12) includes at least one channel (24) formed in one of a wall of a cylinder housing (14) of the control cylinder (12) and a wall of a internal piston (20) disposed in the cylinder housing (14) and a seal (26) including a flexible member adapted to be disposed in a groove in the other one of the wall of the cylinder housing (14) and the wall of the piston (20), the seal (26) cooperating with the at least one channel (24) when the piston (20) is in a defined position to allow airflow past the piston (20) and cooperating with one of the cylinder housing (14) and the piston (20) when the piston (20) is in a position outside the defined position to prevent airflow past the piston (20).

15 Claims, 7 Drawing Sheets

(56) References Cited

U.S. PATENT DOCUMENTS

| | | | | |
|---|---|---|---|---|
| 5,946,912 | A | 9/1999 | Hung | |
| 6,851,350 | B2 | 2/2005 | Lissel et al. | |
| 7,083,170 | B2 | 8/2006 | Borstel et al. | |
| 8,413,994 | B2 | 4/2013 | Jordan | |
| 9,109,704 | B2 | 8/2015 | Borchers et al. | |
| 9,255,590 | B2 | 2/2016 | Schuller et al. | |
| 9,657,755 | B2 * | 5/2017 | Wilmot | F15B 15/1438 |
| 2011/0079141 | A1 | 4/2011 | Steury et al. | |

FOREIGN PATENT DOCUMENTS

| | | | | |
|---|---|---|---|---|
| DE | 102005043167 | B4 | 8/2007 | |
| DE | 102006053285 | A1 | 5/2008 | |
| DE | 102010025078 | A1 | 12/2011 | |
| DE | 102011005406 | A1 | 9/2012 | |
| DE | 202013001260 | U1 | 5/2014 | |
| EP | 1344949 | B1 | 4/2007 | |
| EP | 1442225 | B1 | 5/2008 | |
| EP | 1950429 | A1 | 7/2008 | |
| EP | 2171290 | A1 | 4/2010 | |
| EP | 2345816 | A2 | 7/2011 | |
| EP | 2792887 | A1 | 10/2014 | |
| FR | 2789738 | A1 * | 8/2000 | B60T 11/16 |
| GB | 2203492 | B | 10/1988 | |
| JP | 11236973 | A * | 8/1999 | |
| WO | 2006004413 | A1 | 1/2006 | |
| WO | 2009015865 | A1 | 2/2009 | |

OTHER PUBLICATIONS

Machine Assisted English language abstract for DE 102004037282, downloaded from Espacenet.com on Nov. 10, 2017; 19 pages.
Machine Assisted English language abstract for DE 202013001260 downloaded from Espacenet.com on Nov. 10, 2017; 24 pages.
Issued Patent of GB 2203492 B, downloaded from Espacenet.com on Nov. 10, 2017; 12 pages.
Machine Assisted English language abstract for FR 2789738, downloaded from Espacenet.com on Nov. 10, 2017; 25 pages.
International Search Report for Application No. PCT/IB2016/052754 dated Sep. 21, 2016, 4 pages.
English language abstract for DE102005043167B4 extracted from espacenet.com database on Mar. 12, 2018, 1 page.
English language abstract for DE102006053285A1 extracted from espacenet.com database on Mar. 12, 2018, 2 pages.
English language abstract for DE102010025078A1 extracted from espacenet.com database on Mar. 12, 2018, 2 pages.
English language abstract for DE102011005406A1 extracted from espacenet.com database on Mar. 12, 2018, 1 page.
English language abstract for EP1344949B1 extracted from espacenet.com database on Mar. 12, 2018, 1 page.
Computer-generated English language abstract for EP2171290A1 extracted from espacenet.com database on Mar. 12, 2018, 3 pages.
English language abstract for EP2345816A2 extracted from espacenet.com database on Mar. 12, 2018, 1 page.
English language abstract for WO2009015865A1 extracted from espacenet.com database on Mar. 12, 2018, 1 page.

* cited by examiner

POSITION DEPENDENT VALVE DEVICE FOR CONTROL CYLINDER

RELATED APPLICATIONS

This application is the National Stage of International Patent Application No. PCT/IB2016/052754, filed on May 12, 2016, which claims priority to and all the advantages of U.S. Provisional Patent Application No. 62/160,364, filed on May 12, 2015, the contents of which are expressly incorporated herein by reference.

BACKGROUND OF THE INVENTION

1. Field of the Invention

The present invention relates generally to valve devices for control cylinders and, more particularly, to a position dependent valve device for a control cylinder.

2. Description of the Related Art

It is known to provide a pneumatically actuated control cylinder for actuating components in a powertrain such as gears and clutches in a transmission. The control cylinder typically includes a movable internal piston disposed in a chamber therein. For a valve arrangement of the pneumatically actuated control cylinder, leakage in a supply valve will cause a slow pressure buildup in the chamber of the control cylinder, followed by undesired shifting of the piston of the control cylinder. As such, it is desirable to prevent such shifting.

It is also known to provide seals for valves to prevent fluid flow such as air past a portion of the valve. Typically, these seals are made of a flexible material such as rubber or metal.

Accordingly, it is desirable to provide a position dependent valve device for a pneumatically actuated control cylinder that prevents undesired shifting, has no moving parts, is position dependent in addition to flow dependent, and is low cost. Therefore, there is a need in the art to provide a position dependent valve device that meets at least one of these desires.

SUMMARY OF THE INVENTION

Accordingly, the present invention provides a position dependent valve device to allow small airflows past, avoiding shifting of the internal piston of the control cylinder such as moving forward.

In one embodiment, the present invention provides a position dependent valve device for a control cylinder including at least one channel formed in one of a wall of a cylinder housing of the control cylinder and a wall of an internal piston disposed in the cylinder housing and a seal including a flexible member adapted to be disposed in a groove in the other one of the wall of the cylinder housing and the wall of the piston. The seal cooperates with the at least one channel when the piston is in a rearward position to allow airflow past the piston and cooperating with the one of the cylinder housing and the piston when the piston is in a forward position to prevent airflow past the piston.

In another embodiment, the present invention provides a position dependent valve device for a control cylinder including an air passage adapted to be formed in a wall of a cylinder housing of the control cylinder and having a first aperture for communication with a chamber of the cylinder housing, a second aperture in communication with the chamber of the cylinder housing, and a seal adapted to be disposed in a groove in a wall of a piston disposed in the chamber. The seal cooperates with the second aperture when the piston is in a defined position to allow airflow past the piston and cooperating with the cylinder housing when the piston is in a position outside the defined position to prevent airflow past the piston.

One advantage of the present invention is that a position dependent valve device is provided for a pneumatically actuated control cylinder. Another advantage of the present invention is that the position dependent valve device has no moving parts. Yet another advantage of the present invention is that the position dependent valve device is both position dependent and flow dependent. Still another advantage of the present invention is that the position dependent valve device is a relatively low cost device.

Other features and advantages of the present invention will be readily appreciated, as the same becomes better understood, after reading the subsequent description taken in conjunction with the accompanying drawings.

DESCRIPTION OF THE PREFERRED EMBODIMENT(S)

As disclosed in FIGS. 1 through 4, one embodiment of a position dependent valve device 10, according to the present invention, is shown for a control cylinder, generally indicated at 12. In one embodiment, the control cylinder 12 is a pneumatic actuator for moving components of a vehicle powertrain (not shown) such as gears and clutches in an automized transmission. It should be appreciated that the control cylinder 12 may be used in other embodiments for the vehicle other than the powertrain.

Figure 1:
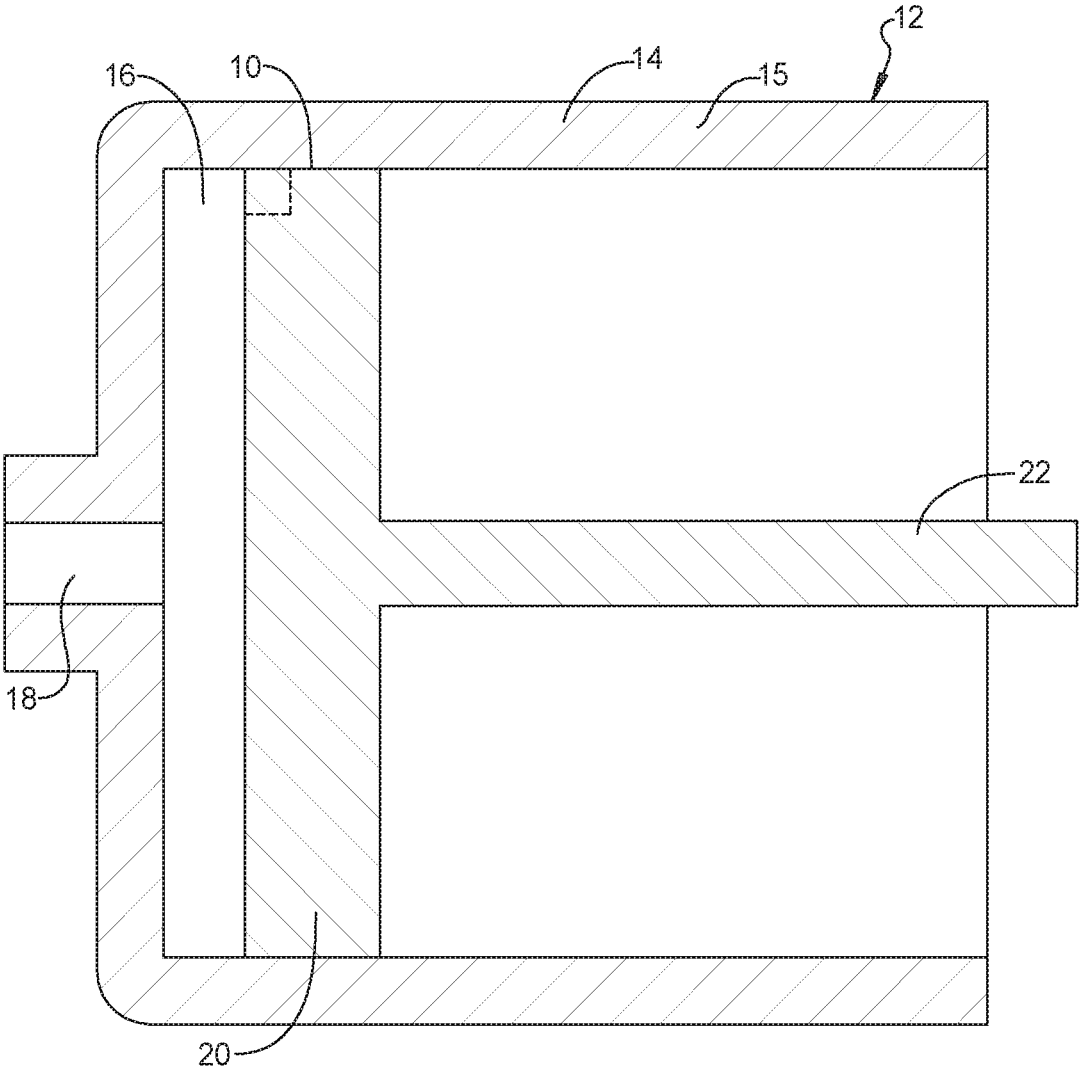
FIG. 1 is a fragmentary elevational view of a position dependent valve device for a control cylinder, according to one embodiment of the present invention.

Referring to FIG. 1, the control cylinder 12 includes a cylinder housing 14 extending axially. In one embodiment, the control cylinder 12 is of a single-acting type. The cylinder housing 14 is generally cylindrical in shape with a generally circular cross-section. The cylinder housing 14 has a wall 15 forming a chamber 16 therein. In one embodiment, the wall 15 extends radially to form a closed end of the cylinder housing 14 and extends axially from the closed end. The cylinder housing 14 includes an opening or aperture 18 extending therein and fluidly communicating with the chamber 16. In one embodiment, the aperture 18 extends through the closed end of the cylinder housing 14. The aperture 18 allows air from a source (not shown) to enter into the chamber 16. It should be appreciated that the cylinder housing 14 may have any suitable shape and the aperture 18 located at any suitable location.

The control cylinder 12 also includes a movable internal piston 20 disposed in the chamber 16. The piston 20 is generally cylindrical in shape. The piston 20 has a diameter less than a diameter of the cylinder housing 14 to allow the piston 20 to be movable in the chamber 16 of the cylinder housing 14. The rearward end of the piston 20 has a slightly reduced diameter to allow airflow past the end thereof. The control cylinder 12 may include a piston rod 22 connected to and extending axially from the piston 20 for actuation of a component (not shown). It should be appreciated that, in contrast to the embodiment of a single-acting control cylinder 12, the control cylinder 12 can also be provided as a double-acting control cylinder 12, in which a further piston chamber for retraction of the piston rod 22 is provided in addition to the chamber 16 for extension of the piston rod 22. It should further be appreciated that valves for raising and lowering the pressure may also be provided for this further piston chamber.

Figure 3:
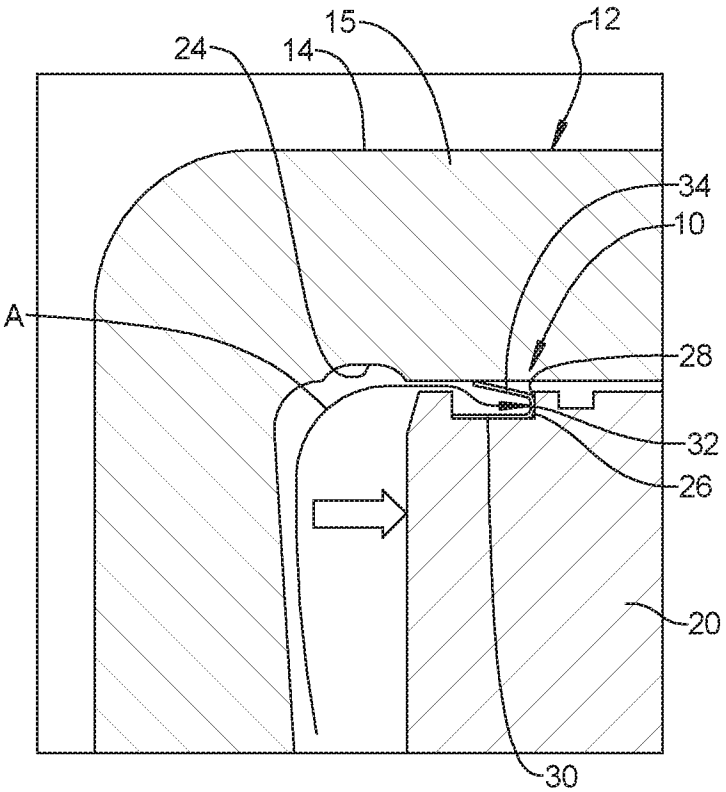
FIG. 3 is an enlarged fragmentary elevational view of the position dependent valve device and control cylinder of FIG. 1 illustrated in a second operational position.
Figure 2:
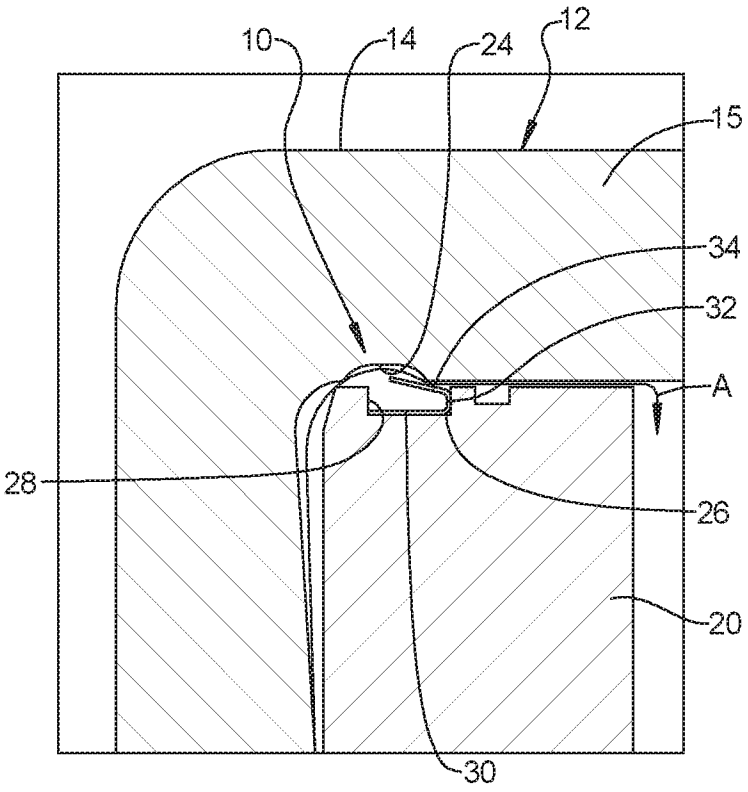
FIG. 2 is an enlarged fragmentary elevational view of the position dependent valve device and control cylinder of FIG. 1 illustrated in a first operational position.
Figure 4:
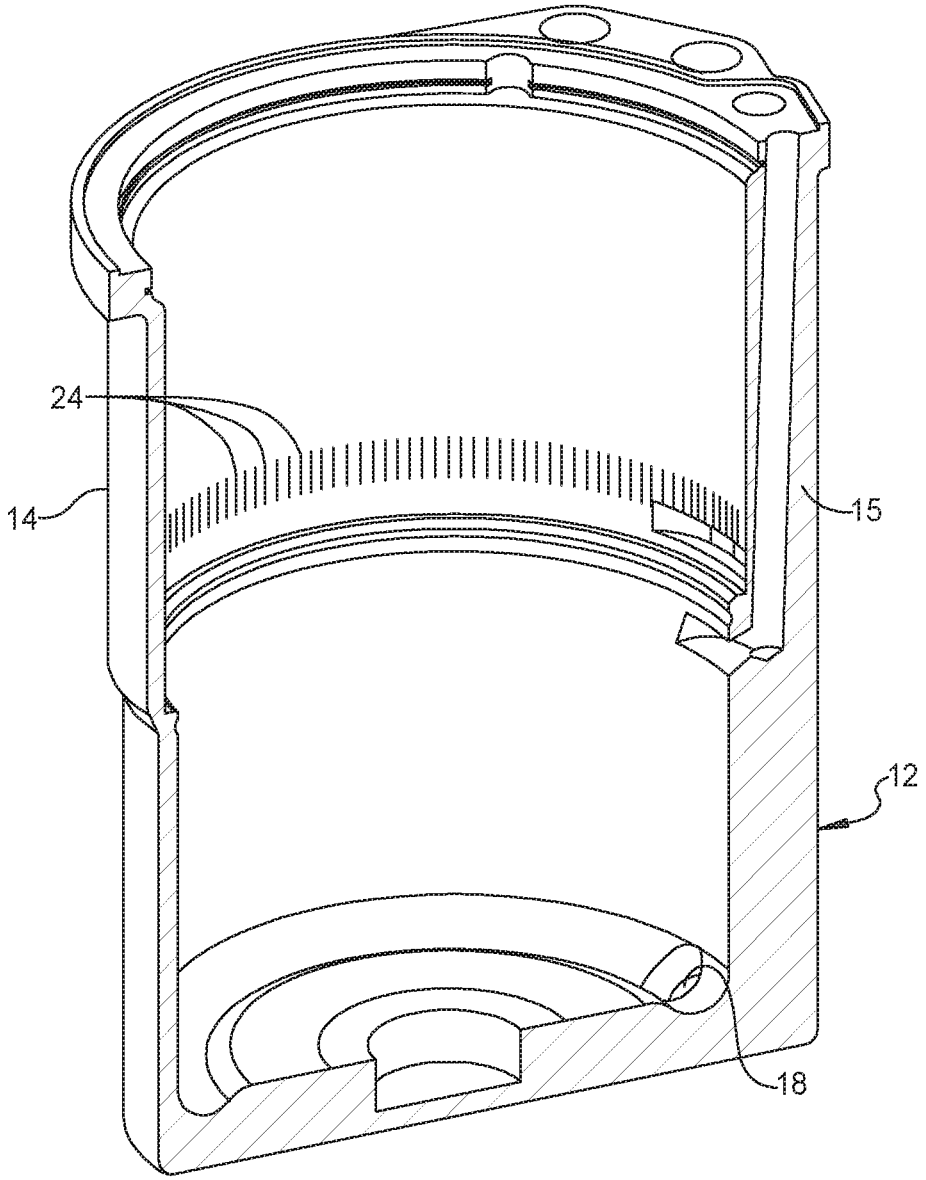
FIG. 4 is a fragmentary perspective view of a portion of the position dependent valve device and control cylinder of FIG. 1.

Referring to FIGS. 2 and 3, the position dependent valve device 10 is shown installed on the control cylinder 12. In this embodiment, the position dependent valve device 10 includes at least one slot or channel 24 in a wall of the cylinder housing 14. The channel 24 extends radially into the wall 15 of the cylinder housing 14. In one embodiment, the channel 24 may extend circumferentially partially or completely. In another embodiment as illustrated in FIG. 4, a plurality of channels 24 may extend linearly and axially along the wall 15 of the cylinder housing 14. In this embodiment, the channels 24 are produced by any suitable process to create the channels 24 with a predetermined length and depth. It should be appreciated that the one or more channels 24 have a width, length, and depth sufficient for a predetermined air leakage or "breathing" area.

Figure 5A:
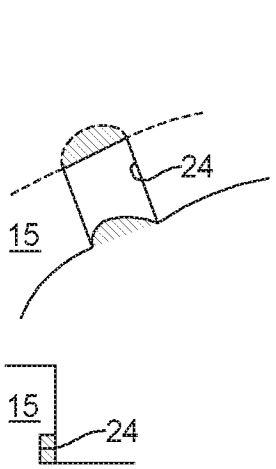
FIGS. 5A, 5B, 5C, and 5D are perspective views of various embodiments for a channel of the position dependent valve device of FIGS. 1 through 4.
Figure 5B:
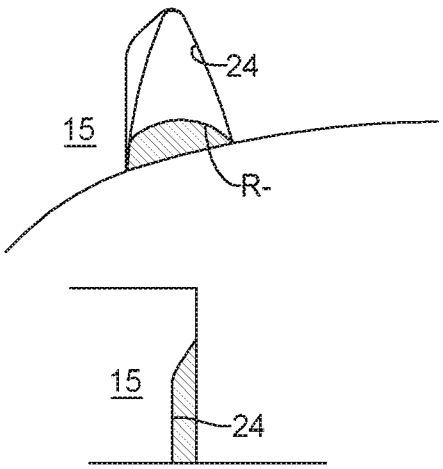
Figure 5C:
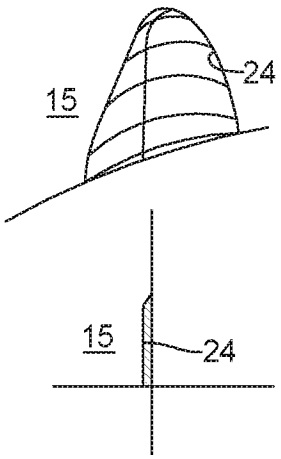
Figure 5D:
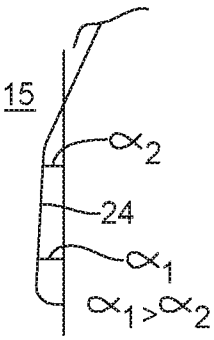

The channel 24 may have any suitable shape. In one embodiment, the channel 24 may be arcuately shaped as illustrated in FIG. 5A. In another embodiment, the channel 24 may be parabolically shaped as illustrated in FIG. 5B. In yet another embodiment, the channel 24 may be shaped to have a depth $\alpha_1$ greater than a depth $\alpha_2$ as illustrated in FIGS. 5C and 5D. It should be appreciated that the channel 24 may have any suitable shape to allow for a predetermined flow rate of air leakage. It should also be appreciated that the channel 24 must be made in such a way that a seal 26 to be described is not damaged in any way.

In one embodiment, the position dependent valve device 10 also includes a seal 26 disposed in a groove 28 of the piston 20. The groove 28 is generally annular and rectangular in shape, but may have any suitable shape. The groove 28 extends radially inwardly into a wall of the piston 20. The seal 26 is generally annular in shape. In one embodiment, the seal 26 has a generally backward "C" shape. In that embodiment, the seal 26 has an inner portion 30 extending axially, a mid portion 32 extending radially from one end of the inner portion 30, and an outer portion 34 extending axially and radially at an angle from the one end of the mid portion 32. The outer portion 34 engages the wall 15 of the cylinder housing 14. In one embodiment, the outer portion 34 forms a flexible member. The seal 26 is made of a flexible elastomeric material such as rubber. The seal 26 is integral, unitary, and one-piece. It should be appreciated that the seal 26 cooperates with one or more channels 24 in certain positions of the piston 20 in the chamber 16 relative to the cylinder housing 14. It should also be appreciated that the seal 26 may be any suitable type of seal such as a lip seal, o-ring, etc.

In operation of the position dependent valve device 10, as illustrated in FIG. 2, when the piston 20 is near the end of the cylinder housing 14, the outer portion 34 of the seal 26 cooperates with the one or more channels 24. The seal 26 is positioned so that airflow A can pass the seal 26 at this very point. This will let airflow A past the seal 26 only with the piston 20 in a defined "breathing" (shown rearmost) position. It should be appreciated that, in this position, the one or more channels 24 let airflow A leakage past the seal 26. It should also be appreciated that the one or more channels 24 function as a valve if the position of the piston 20 is moved slightly away from or outside the defined position (shown forward).

As illustrated in FIG. 3, when the piston 20 moves forward away from the end of the cylinder housing 14, the outer portion 34 of the seal 26 engages an inner surface of the wall 15 of the cylinder housing 14. Airflow A entering from the rear of the piston 20 may flow into the seal 26, but the upper portion 34 engaging the inner surface prevents airflow from leaking past the piston 20. It should be appreciated that, in this position, the piston 20 moves past the one or more channels 24 and the seal 26 closes off airflow A or air leakage. It should also be appreciated that the valve device 10 is position dependent to let small airflows past, avoiding pressure buildup in the chamber 16, resulting in undesired shifting of the piston 20 in the chamber 16 of the control cylinder 12.

Figure 7:
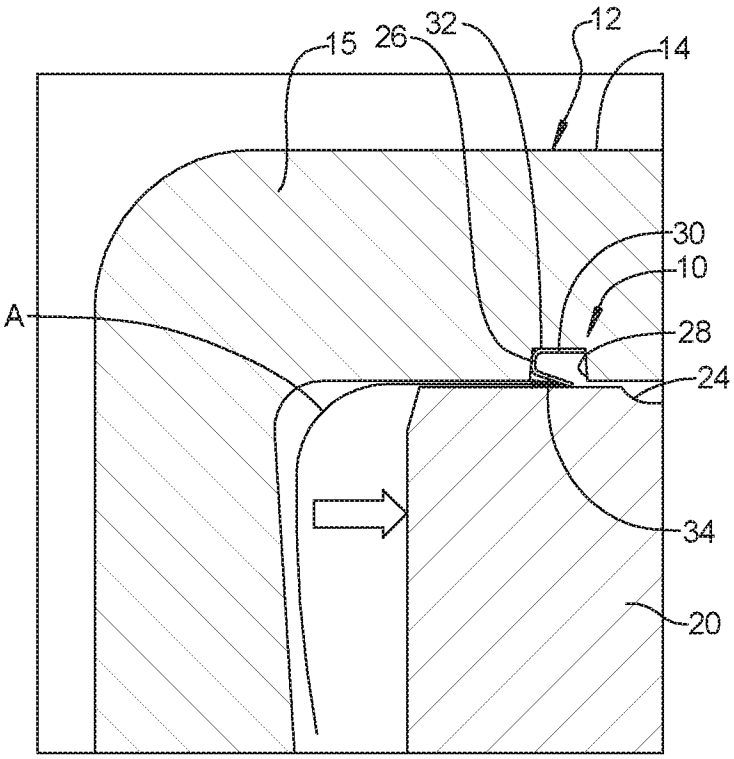
FIG. 7 is an enlarged fragmentary elevational view of the position dependent valve device and control cylinder of FIG. 6 illustrated in a second operational position.
Figure 6:
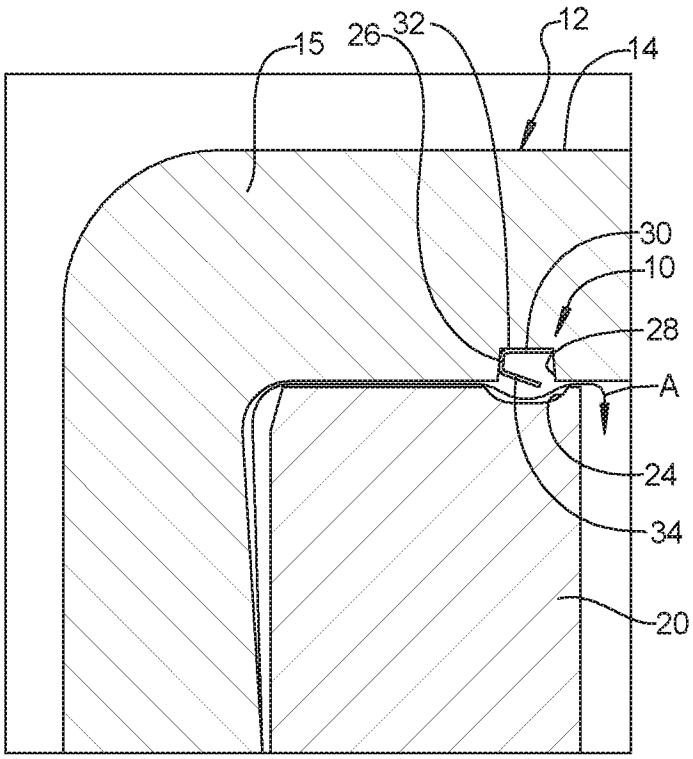
FIG. 6 is an enlarged fragmentary elevational view of another embodiment, according to the present invention, of the position dependent valve device and control cylinder of FIGS. 1 through 4 illustrated in a first operational position.
Figure 9:
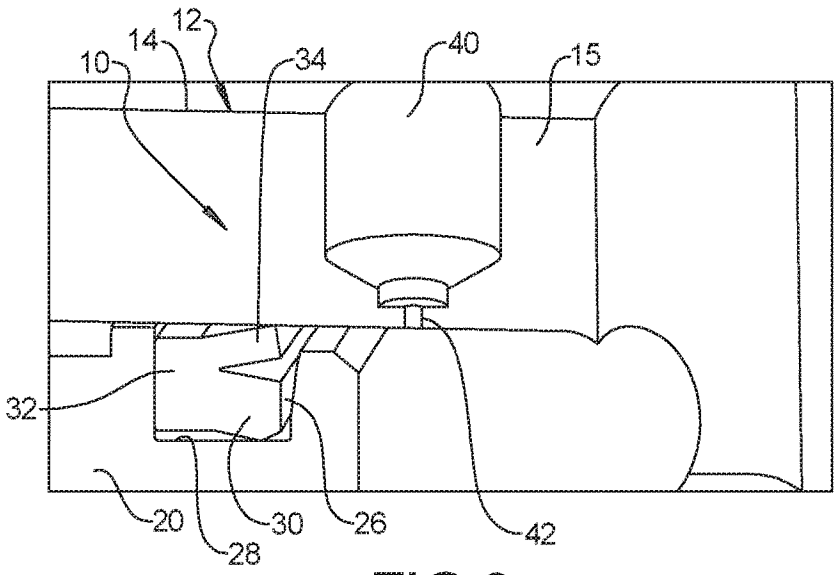
FIG. 9 is an enlarged fragmentary elevational view of the position dependent valve device of FIG. 8 illustrated in a second operational position.

Referring to FIGS. 6 and 7, another embodiment, according to the present invention, of the position dependent valve device 10 is shown. Like parts have like reference numerals. In this embodiment, the position dependent valve device 10 includes at least one slot or channel 24 in a wall of the piston 20. The at least one channel 24 extends radially into a wall of the piston 20. In one embodiment, the at least one channel 24 may be a plurality of channels 24 that may extend linearly and axially along the wall of the piston 20. The position dependent valve device 10 also includes a seal 26 disposed in a groove 28 of the cylinder housing 14. The groove 28 extends radially inwardly into the wall 15 of the cylinder housing 14. In that embodiment, the seal 26 has an inner portion 30 extending axially, a mid portion 32 extending radially from one end of the inner portion 30, and an outer portion 34 extending axially and radially at an angle from the one end of the mid portion 32. In one embodiment, the outer portion 34 forms a flexible member and engages the wall of the piston 20. It should be appreciated that the operation of the position dependent valve device 10 is similar to that of FIGS. 2 and 3.

Figure 8:
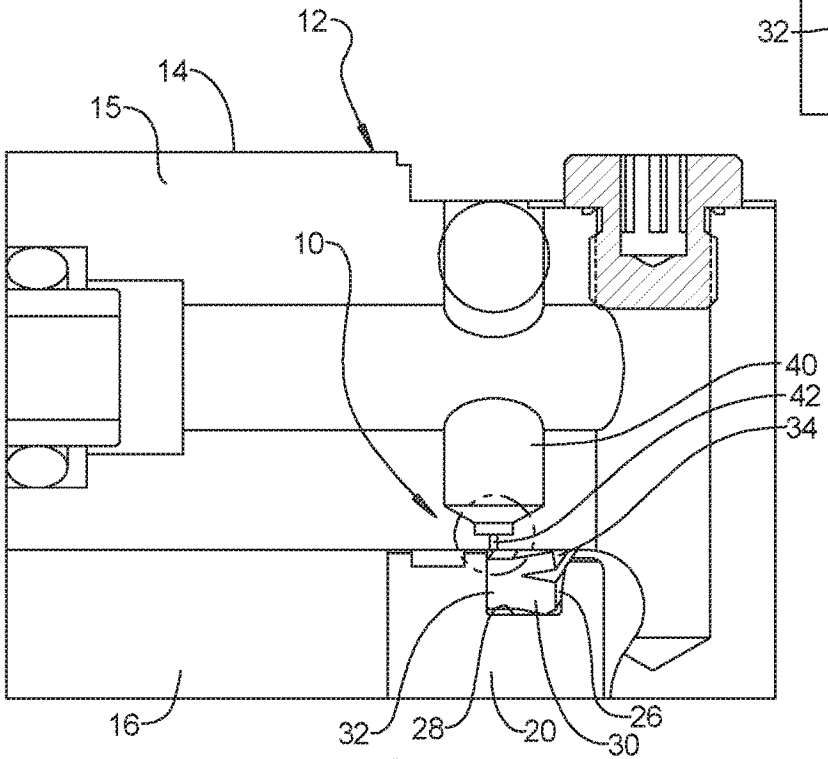
FIG. 8 is an enlarged fragmentary elevational view of yet another embodiment, according to the present invention, of the position dependent valve device of FIGS. 1 through 4 illustrating a single orifice passage and a first operational position.
Figure 10:
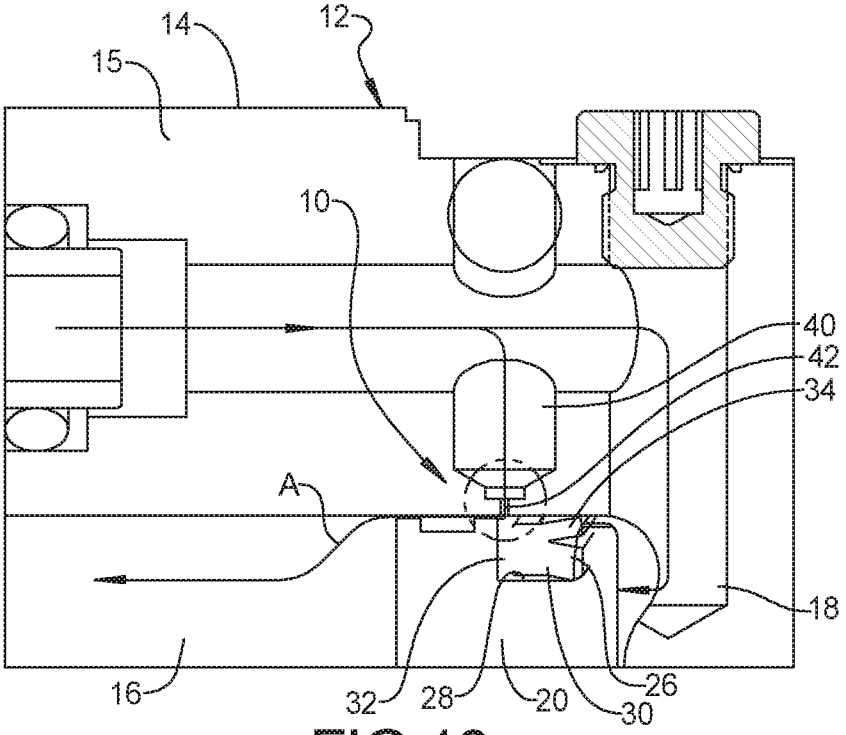
FIG. 10 is an enlarged fragmentary elevational view of the position dependent valve device of FIG. 8 illustrated in the first operational position.
Figure 11:
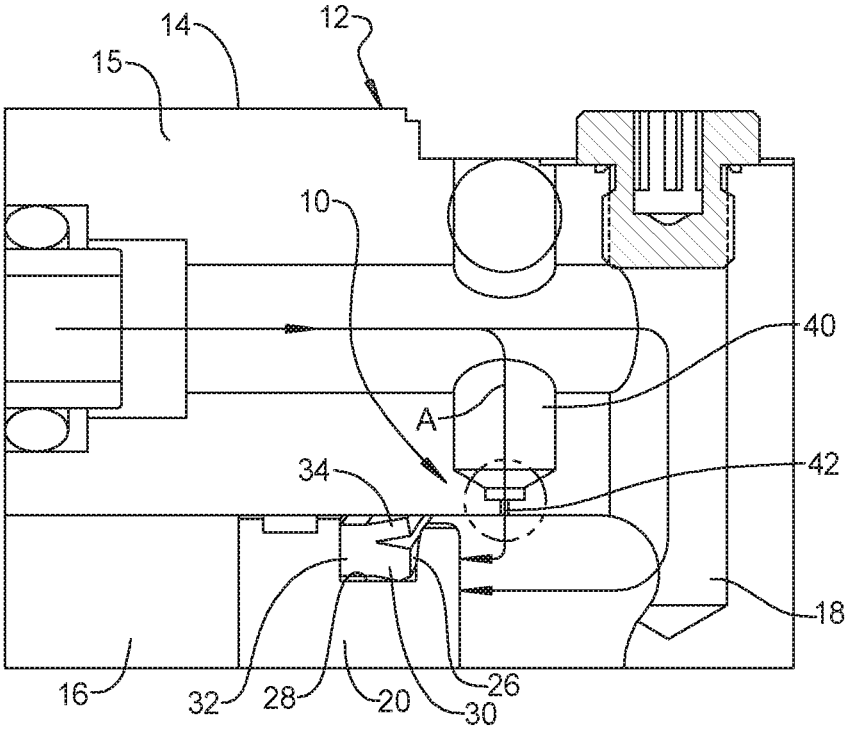
FIG. 11 is an enlarged fragmentary elevational view of the position dependent valve device of FIG. 9 illustrated in the second operational position.

Referring to FIGS. 8 through 11, yet another embodiment, according to the present invention, of the position dependent valve device 10 is shown. Like parts have like reference numerals. In this embodiment, the position dependent valve device 10 eliminates the channel 24 and includes a passageway 40 formed in the wall 15 of the cylinder housing 14 having a single orifice 42 in communication with the chamber 16 of the control cylinder 12. The orifice 42 is located forward of the outer portion 34 of the seal 26 when the piston 20 is in its rearmost position as illustrated in FIG. 8. In operation, when the piston 20 is in its rearmost position, air from the passageway 40 leaks through the orifice 42 into the chamber 16 of the cylinder housing 14 bypassing the seal 26 to avoid pressure build up in the control cylinder 12 as illustrated in FIG. 10. After the piston 20 is moved a predetermined distance forward, air through the orifice 42 is directed behind the piston 20, contributing to the flow through the inlet port or aperture 18 as illustrated in FIG. 11. It should be appreciated that, in this embodiment, the valve device 10 is a single orifice passive leakage valve.

Accordingly, in the present invention, the position dependent valve device 10 advantageously provides no moving parts, is position dependent in addition to flow dependent, and is low cost. The position dependent valve device 10 advantageously allows small air flows past, avoiding pressure buildup and forward movement of the piston 20 in the control cylinder 12.

The present invention has been described in an illustrative manner. It is to be understood that the terminology, which has been used, is intended to be in the nature of words of description rather than of limitation.

Many modifications and variations of the present invention are possible in light of the above teachings. Therefore, the present invention may be practiced other than as specifically described.

What is claimed is:

1. A position dependent valve device (10) for a pneumatically actuated control cylinder (12) extending axially along an axis, said valve device (10) comprising:

at least one channel (24) formed in a wall of a cylinder housing (14) of the control cylinder (12) and located at an end of the cylinder housing (14);

a seal (26) at least partially disposed in a groove in a wall of a piston (20) with the piston having a rearward end and a distal end opposed to the rearward end, said groove located adjacent the distal end of the piston;

said seal including an inner portion (30) extending axially relative to the axis and disposed in said groove in the wall of the piston (20), a mid portion (32) extending radially from said inner portion (30), and a flexible member extending radially and axially from said mid portion at an angle relative to the axis, wherein said flexible member is adapted to engage a surface of the wall of the cylinder housing (14); and said seal (26) having said flexible member extending outwardly into said at least one channel and cooperating with said at least one channel (24) when the piston (20) is in a defined position to allow airflow past the piston (20) without actuation of the piston (20) and said flexible member being compressed inwardly and cooperating with the surface of the cylinder housing (14) when the piston (20) is actuated to a position outside the defined position to prevent airflow past the piston (20).

2. A position dependent valve device (10) as set forth in claim 1 wherein said at least one channel (24) extends radially inward into the wall (15) of the cylinder housing (14).

3. A position dependent valve device (10) as set forth in claim 2 wherein said at least one channel (24) comprises a plurality of channels disposed circumferentially about the wall of the cylinder housing (14).

4. A position dependent valve device (10) as set forth in claim 1 wherein said at least one channel (24) has a width and depth sufficient for a predetermined air leakage.

5. A position dependent valve device (10) as set forth in claim 1 wherein said seal (26) is annular in shape.

6. A position dependent valve device (10) as set forth in claim 1 wherein said seal (26) has a "C" shape.

7. A position dependent valve device (10) as set forth in claim 1 wherein said seal (26) has an outer portion (34) forming said flexible member and extending from said one end of said mid portion (32).

8. A position dependent valve device (10) for a pneumatically actuated control cylinder (12) extending axially along an axis, said valve device (10) comprising:

an air passage adapted to be formed in a wall of a cylinder housing (14) of the control cylinder (12) and having a first aperture in communication with a chamber of the cylinder housing (14);

a second aperture located at an end of the cylinder housing (14) and in communication with the chamber of the cylinder housing (14); and a seal (26) at least partially disposed in a groove in a wall of an internal piston (20) with the piston having a rearward end and a distal end opposed to the rearward end, said groove located adjacent the distal end of the piston;

said seal including an inner portion (30) extending axially relative to the axis and disposed in said groove in the wall of the internal piston (20) disposed in the chamber, a mid portion (32) extending radially from said inner portion (30), and a flexible member extending radially and axially from said mid portion at an angle relative to the axis, wherein said flexible member is adapted to engage a surface of the wall of the cylinder housing (14), said seal (26) having said flexible member extending outwardly into said second aperture and cooperating with said second aperture when the piston (20) is in a rearward position to allow airflow past the piston (20) without actuation of the piston (20) and said flexible member being compressed inwardly and cooperating with the surface of the cylinder housing (14) when the piston (20) is actuated to a forward position to prevent airflow past the piston (20).

9. A position dependent valve device (10) as set forth in claim 8 wherein said second aperture comprises a passageway (40) formed in the wall of the cylinder housing (14).

10. A position dependent valve device (10) as set forth in claim 9 wherein said passageway (40) has a single orifice (42) in communication with the chamber (16) of the cylinder housing (14).

11. A position dependent valve device (10) as set forth in claim 10 wherein said single orifice (42) is located forward of said seal (26) when said piston (20) is in its rearmost position.

12. A position dependent valve device (10) as set forth in claim 8 wherein said second aperture communicates with said air passage.

13. A position dependent valve device (10) as set forth in claim 8 wherein said seal (26) is annular in shape.

14. A position dependent valve device (10) as set forth in claim 8 wherein said seal (26) has a "C" shape.

15. A position dependent valve device (10) as set forth in claim 8 wherein said seal (26) has an outer portion (34) forming said flexible member and extending from the one end of said mid portion (32).

* * * * *